US005221378A

United States Patent [19]

Nishiura et al.

[11] Patent Number: 5,221,378

[45] Date of Patent: Jun. 22, 1993

[54] METHOD FOR THE PREPARATION OF HIGH-STRENGTH FINE WIRE OF HIGH-CARBON STEEL

[75] Inventors: Shuji Nishiura, 1443, Tsuruhara, Izumisano-shi, Osaka-fu; Yoshitaka Nishiura, Izumi, both of Japan

[73] Assignee: Shuji Nishiur, Izumisano, Japan

[21] Appl. No.: 971,193

[22] Filed: Nov. 4, 1992

[51] Int. Cl.[5] ..... C21D 8/06

[52] U.S. Cl. ..... 148/596; 148/599

[58] Field of Search ..... 148/596, 599

[56] References Cited

U.S. PATENT DOCUMENTS 4,375,378 3/1983 Ohtani et al. ..... 148/596

4,620,884 11/1986 Heath ..... 148/596

FOREIGN PATENT DOCUMENTS 51-50805 5/1976 Japan ..... 148/596

*Primary Examiner*—Deborah Yee

*Attorney, Agent, or Firm*—Wyatt, Gerber, Burke and Badie

[57] ABSTRACT

An improved method is proposed for the manufacture of a very fine high-carbon steel wire having a diameter of 50 μm or smaller. In the wire drawing process by repeating a plural number of cycles each consisting of a patenting treatment and a cold-drawing treatment starting from a base steel wire rod, the final drawing treatment is preceded by a heat treatment of the intermediate wire having a diameter of about 100–500 μm in an atmosphere of a gaseous mixture of 90–98% by volume of nitrogen and 2–10% by volume of hydrogen at 750°–900° C. for 1–30 seconds so that the final drawing can be safely conducted without breaking of the fine wire.

3 Claims, 1 Drawing Sheet

FIGURE
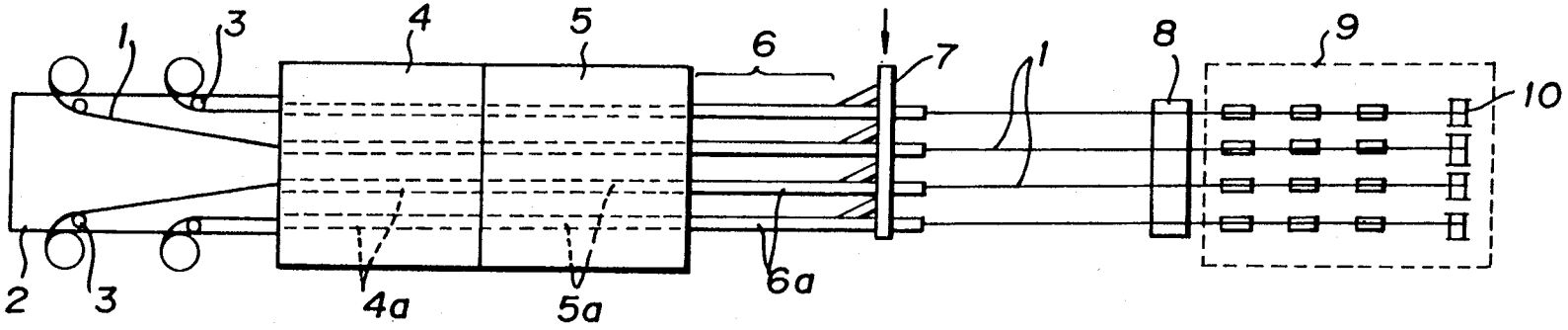

METHOD FOR THE PREPARATION OF HIGH-STRENGTH FINE WIRE OF HIGH-CARBON STEEL

BACKGROUND OF THE INVENTION

The present invention relates to an improvement in the method for the preparation of a high-strength fine wire of high-carbon steel by repeating patenting and cold-drawing. More particularly, the invention relates to an improvement in the method for the preparation of a high-strength fine wire of high-carbon steel having a diameter, for example, not exceeding 50 μm and useful as a base material of tire cord wires, conveyor belt wires, high pressure-hose reinforcing wires, wire saws, mesh filters, precision springs and the like.

Very fine steel wires having a diameter of 100 μm or smaller are manufactured usually by repeatedly subjecting a starting hot-drawn wire rod having a diameter of, for example, 5.5 mm to cold drawing and patenting treatment in a non-oxidizing atmosphere successively reducing the diameter or cross section of the wire in each cold drawing. It is generally understood in the prior art that the above mentioned wire-drawing process is not applicable to the manufacture of a high-carbon steel wire having a diameter of 50 μm or smaller which should have a very high tensile strength of 300 to 800 kgf/mm$^2$. The high-carbon steel here implied includes steels of those grades such as SWRS82A specified in JIS G 3507 which contains 0.51 to 0.86% by weight of carbon, 0.35% by weight or less of silicon and 0.5% by weight or less of manganese. Namely, a steel wire having a diameter of 100 to 200 μm after cold drawing in a working degree, i.e. reduction of cross section, of 90 to 96% is already in a state of overworking so that no further cold drawing can be undertaken thereof without subjecting the wire to another patenting treatment. Nevertheless, a patenting treatment of such a fine steel wire can practically no longer be undertaken due to the problems of surface oxidation, spontaneous leaning and the like if not to mention breaking of the wire by a pickling treatment with a diluted acid solution.

SUMMARY OF THE INVENTION

The present invention accordingly has an object to provide an improvement in the method for the manufacture of a fine wire of a high-carbon steel by which fine steel wires can be manufactured by repeating the cycles of cold drawing and patenting treatment with high efficiency and good productivity even when the diameter of the final steel wire product is 50 μm or smaller by overcoming the limitation of the process relative to the diameter of the wire to be drawn.

Thus, the present invention provides an improvement which comprises, in a method for the manufacture of a fine high-carbon steel wire having a diameter not exceeding 50 μm by repeating a plural number of cycles each consisting of a cold die-drawing treatment and a patenting treatment of a steel wire ending in a final cold die-drawing treatment to successively reduce the diameter of the wire in each cold die-drawing treatment, heating the wire having a diameter reduced to 100 to 500 μm, prior to the final cold die-drawing treatment, in an atmosphere of a gaseous mixture consisting of from 90 to 98% by volume of nitrogen and from 10 to 2% by volume of hydrogen at a temperature in the range from 750° to 900° C. for a length of time in the range from 1 to 30 seconds.

BRIEF DESCRIPTION OF THE DRAWING

The figure is a schematic illustration of an axial cross sectional view of a furnace for performing the heat treatment of steel wires according to the invention.

DETAILED DESCRIPTION OF THE PREFERRED EMBODIMENTS

As is described above, the present invention is applicable to the manufacturing process of a fine wire of high-carbon steel having a diameter not exceeding 50 μm by repeating the cycles of cold die-drawing and patenting treatments. The high-carbon steel here implied is not particularly limitative provided that the content of carbon therein is at least 0.5% by weight. Several grades of high-carbon steels are specified, for example, in JIS G 3507, among which a typical one is the grade of SWRA82A containing from 0.51 to 0.86% by weight of carbon, 0.35% by weight or less of silicon and 0.6% by weight or less of manganese, the balance being iron and unavoidable impurity elements.

The starting material in the wire-drawing process is supplied by the manufacturer in the form of a wire rod having a diameter of 5.5 mm. The wire rod is repeatedly subjected to a plural number of cycles each consisting of a cold die-drawing treatment and patenting treatment in a non-oxidizing atmosphere so as to successively reduce the diameter or cross section of the wire to have an intermediate wire having a diameter reduced to 100 to 500 μm which is subjected to the final cold die-drawing treatment so that the diameter of the final fine steel wire is reduced not to exceed 50 μm. The conditions of the cold die-drawing and patenting treatments of steel wires are well known in the art and can be conventional.

The improvement proposed by the invention consists in that the intermediate steel wire before the final drawing treatment having a diameter reduced to 100 to 500 μm is subjected to a heat treatment under specific conditions. Namely, the steel wire of 100 to 500 μm diameter is heated in an atmosphere of a gaseous mixture consisting of from 90 to 98% or, preferably, from 90 to 95% by volume of nitrogen and from 10 to 2% or, preferably, from 10 to 5% by volume of hydrogen at a temperature in the range from 750° to 900° C. or, preferably, from 800° to 900° C. for a length of time in the range from 1 to 30 seconds or, preferably, from 1 to 10 seconds. When this heat treatment of the intermediate wire is undertaken, the wire can be cold-drawn in the final cold die-drawing to have a working degree of 90% or more relative to the starting wire rod.

The above described heat treatment of the steel wire for such a short time of 1 to 30 seconds can be practiced conveniently by continuously passing the wire through a tubular furnace of an appropriate length at an appropriate velocity so that the staying time of the wire inside of the tubular furnace can be within the range of 1 to 30 seconds. Needless to say, the space in the furnace is filled with the gaseous mixture of nitrogen and hydrogen in the specified volume proportion by passing the gaseous mixture through the furnace. The temperature of the gaseous mixture, through which the wire runs, is kept at 800° to 900° C. The figure of the accompanying drawing is a schematic illustration of an axial cross sectional view of such a tubular furnace in which steel wires are under heat treatment. The tubular furnace consists of a heating zone 4 containing four heating tubes 4a,4a and an annealing zone 5 containing four annealing tubes 5a,5a. Each of the heating tubes 4a,4a is connected to one of the annealing tubes 5a,5a which in turn is connected to one of the four heat-insulated cooling tubes 6a,6a in the cooling zone 6 thus to form a continuous tube 4a-5a-6a. These tubes are filled with a gaseous mixture of nitrogen and hydrogen in a specified volume proportion introduced (shown by the downward arrow) from the gas feeder 7.

The four steel wires 1,1 on the guide rollers 3,3 are each continuously introduced at an appropriate running velocity from the wire feeder 2 into the respective tubes in the furnace and wound up on the respective wire bobbins 10,10, which also serve to give an adequate tension to the wires, in the wire take-up unit 9 after oiling with a rustproof oil in the oiling device 8.

The lengths of the heating zone 4, annealing zone 5 and cooling zone 6 as well as the running velocity of the wires are controlled in such a way that the wire 1 running in the heating tube 4a is heated therein at the specified temperature of 750° to 900° C. for a specified length of time of 1 to 30 seconds. The length and temperature of the annealing tubes 5a,5a and the length and heat insulation of the cooling tubes 6a,6a should be so designed that the cooling rate of the wire 1 coming out of the heating tube 4a and running therethrough is not too large. When the heat treatment of the steel wire is conducted to satisfy these conditions, the steel wire after the heat treatment has a very uniform and fine texture of sorbite so that the wire can be subjected to a subsequent cold drawing treatment without any troubles to have a working degree of 90% or larger into a very fine wire of 50 μm or smaller diameter having a tensile strength of 400 kgf/mm$^2$ or larger.

The steel wire 1 wound up on the wire bobbin 10 after the heat treatment is then subjected to the final cold die-drawing which is conducted in a conventional drawing machine according to a conventional procedure so that no detailed description thereof is given here.

In the following, the improvement according to the invention is described in more detail by way of examples.

EXAMPLE 1

The apparatus illustrated in the figure of the drawing was used for the heat treatment of high-carbon steel wires each having a diameter of 170 μm after repetition of cold die-drawing and tempering treatments. The starting high-carbon steel was a wire rod of the grade SWRA82A specified in JIS G 3502 having a diameter of 5.5 mm and contained 0.83% by weight of carbon, 0.17% by weight of silicon, 0.48% by weight of manganese, 0.11% by weight of phosphorus, 0.13% by weight of sulfur and 0.01% by weight of copper, the balance being iron and trace amounts of other impurities.

The steel wires were each introduced into the heating tube 4a having a length of 100 cm and kept at 800° C. at a velocity of 12 meters/minute so that the staying time of the steel wire in the heating zone was 5 seconds. The heating tube 4a was integrally connected with the annealing tube 5a kept at 500° C., which was further integrally connected with the cooling tube 6a. These tubes were filled with a gaseous mixture consisting of 95% by volume of nitrogen and 5% by volume of hydrogen. The steel wires coming out of the heating zone were gradually cooled through the annealing zone and cooling zone and wound up on the wire bobbins.

The steel wire after the above described heat treatment was subjected to the final cold die-drawing treatment by using a wire-drawing apparatus having pairs of multi-stage capstans according to a conventional procedure so as to have a reduced diameter of 20 μm with a working degree of 98% based on the starting wire rod. The thus obtained fine high-carbon steel wire had a tensile strength of 778 kgf/mm$^2$.

EXAMPLE 2

The heat treatment of high-carbon steel wires was conducted in the same manner as in Example 1 except that the running velocity of the wires through the tubular furnace was 20 meters/minute to give a staying time of 3 seconds in the heating zone of the furnace and the annealing zone was kept at 600° C. instead of 500° C.

The steel wire after the heat treatment as described above was subjected to the final cold die-drawing treatment in the same manner as in Example 1 to have a reduced diameter of 20 μm. The thus obtained fine high-carbon steel wire had about the same tensile strength as in Example 1.

What is claimed is:

1. In a method for the manufacture of a fine high-carbon steel wire having a diameter not exceeding 50 μm by repeating a plural number of cycles each consisting of a cold die-drawing treatment and a patenting treatment of a steel wire ending in a final cold die-drawing to successively reduce the diameter of the wire in each cold die-drawing, the improvement which comprises heating the wire having a diameter reduced to 100 to 500 μm, prior to the final cold die-drawing treatment, in an atmosphere of a gaseous mixture consisting of from 90 to 98% by volume of nitrogen and from 10 to 2% by volume of hydrogen at a temperature in the range from 750° to 900° C. for a length of time in the range from 1 to 30 seconds.

2. The improvement as claimed in claim 1 in which the steel wire subjected to the heat treatment has a diameter in the range from 100 to 500 μm.

3. The improvement as claimed in claim 1 in which the heat treatment of the steel wire is performed by continuously passing the steel wire through a tubular furnace.

* * * * *